United States Patent [19]

Dillon

[11] Patent Number: 4,691,837

[45] Date of Patent: Sep. 8, 1987

[54] GARBAGE CAN

[76] Inventor: Linwood E. Dillon, 1511 W. 14th St., Hastings, Minn. 55033

[21] Appl. No.: 923,016

[22] Filed: Oct. 23, 1986

[51] Int. Cl.[4] ..... B65D 33/00

[52] U.S. Cl. ..... 220/1 T; 220/18; 220/83; D34/1

[58] Field of Search ..... 220/1 T, 18, 70, 83, 220/404, DIG. 13; D34/1, 5; D6/475

[56] References Cited

U.S. PATENT DOCUMENTS 1,205,064 11/1916 Varian ..... 220/1 T
2,062,793 12/1936 Nicol ..... 220/18 X
2,107,845 2/1938 Albert ..... 220/18 X
2,445,914 7/1948 Hendricks ..... 220/18

*Primary Examiner*—Steven M. Pollard
*Attorney, Agent, or Firm*—Thomas B. Tate

[57] ABSTRACT

The invention is a garbage can which is adapted for use underneath a sink. The garbage can comprises a generally J-shaped chute open at the top of the vertical portion and closed at the end of the horizontal portion of the chute, and having a pivot point at the right-angle bend of the chute, allowing the garbage can to be upright when the door to the undersink cabinet is closed, but to tip toward the user when the cabinet door is open.

1 Claim, 2 Drawing Figures

GARBAGE CAN

SUMMARY AND BACKGROUND OF THE INVENTION

Underneath the kitchen sink is a convenient place to temporarily store household garbage and rubbish until it can be permanently disposed of. However, because the average undersink cabinet is only 22 by 15 inches and this space is further reduced by the presence of the plumbing pipes, conventional round garbage cans do not fit conveniently under the sink. Homeowners often must use small wastebaskets, grocery bags, or similar less satisfactory alternatives.

The object of the present invention is to solve this problem by providing a J-shaped garbage can, which because of its shape, can fit easily under a sink and still hold a large volume of garbage. The invention pivots on the bottom of its right angle bend so that the top opening tilts toward the user to allow garbage to be deposited into the can more easily. Furthermore, the plumbing pipes are not the hindrance that they are for round garbage cans; instead the invention takes advantage of the presence of the plumbing, because the gooseneck pipe acts as a stop which prevents the garbage can from tipping over completely. The invention can be made in different sizes to accommodate undersink cabinets which are not of conventional dimensions.

DESCRIPTION OF THE DRAWINGS

In FIG. 1, the cabinet door (right side of drawing) is closed and in FIG. 2, the cabinet door is open. The views are taken as if one sidewall of the undersink cabinet were removed to reveal the structures inside.

DESCRIPTION OF THE INVENTION

Figure 1:
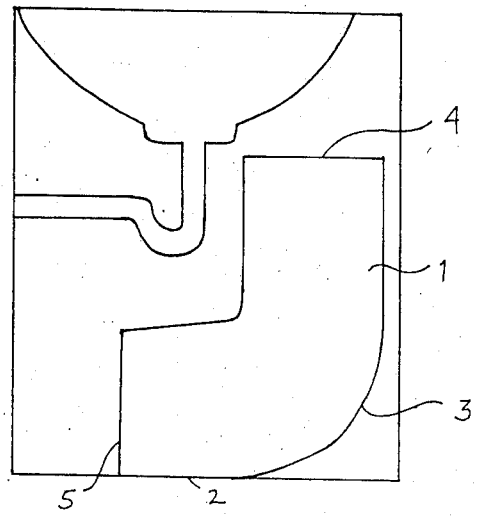
FIGS. 1 and 2 are side views of the device in position under the sink.
Figure 2:
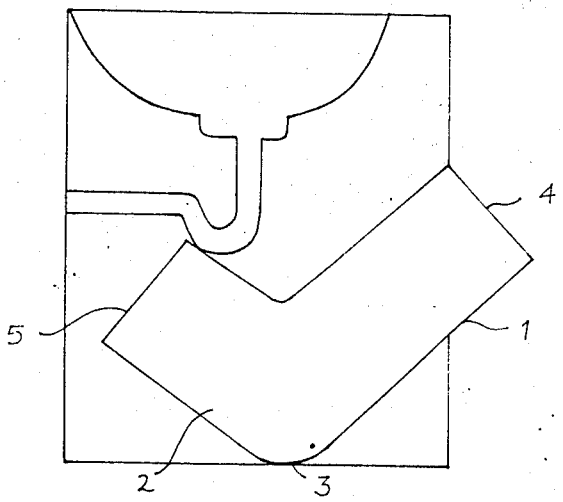

The invention is a garbage can of suitable shape and size for use in the cabinet underneath a sink. When the cabinet door is closed, as in FIG. 1, the can is upright. When the cabinet door is open, as in FIG. 2, the can tips toward the open door to allow easy loading of trash into the can, but is prevented from tipping over completely by the gooseneck pipe of the sink.

The garbage can is made of standard materials such as plastic or rubber. The can is formed as a generally J-shaped chute structure having a vertical portion 1 and a horizontal portion 2, with the right angles formed by vertical portion 1 and horizontal portion 2 being curved bends rather than sharp angles. The curved right-angle bend on the bottom surface of the garbage can acts as a pivot point 3. When the door to the undersink cabinet is opened, the garbage can rocks on this pivot point 3 to tip toward the open door, and when the cabinet door is closed, the garbage can rocks back on pivot point 3 to its original upright position.

The vertical portion 1 of the chute has a rectangular opening 4 at the top, through which the trash is inserted. The horizontal portion 2 of the chute is closed by a rectangular end plate 5, thus preventing the trash from falling out of that end of the garbage can. Because the trash that is put into the garbage can follows the curve of the chute as it is pushed in, the garbage can is capable of being filled fuller than a conventional can of a size that would fit under a sink.

I claim:

1. A garbage can suitable for use under a sink, said garbage can comprising:

a generally J-shaped chute formed as a single piece, said chute having a first, vertical leg formed at generally right angles to a second, horizontal leg;

said right angle formed between said first and second legs being a curved bend so as to provide a pivot point on the exterior bottom surface of said right angle bend;

said first leg having a generally rectangular opening at the top;

said second leg being closed at its generally rectangular end;

said garbage can being capable of being positioned under said sink so that said garbage can is upright when the door to the undersink area is closed, and is tipping outward but prevented from tipping completely over by the gooseneck pipe of said sink when said door is open.

* * * * *